US005191870A

United States Patent [19]

Cook

[11] Patent Number: 5,191,870

[45] Date of Patent: Mar. 9, 1993

[54] DIAGNOSTIC SYSTEM FOR CANISTER PURGE SYSTEM

[75] Inventor: John E. Cook, Chatham, Canada

[73] Assignee: Siemens Automotive Limited, Chatham, Canada

[21] Appl. No.: 770,009

[22] Filed: Oct. 2, 1991

Related U.S. Application Data

[63] Continuation-in-part of Ser. No. 676,672, Mar. 28, 1991.

[51] Int. Cl.[5] ..... F02M 33/02

[52] U.S. Cl. ..... 123/520; 123/198 D

[58] Field of Search ..... 123/TM D, 123/516, 518, 519, 520, 521; 73/119 A

[56] References Cited

U.S. PATENT DOCUMENTS 4,949,695 8/1991 Uranashi ..... 123/198 D
5,085,194 2/1992 Kuroda ..... 123/520
5,085,197 2/1992 Mader ..... 123/518
5,105,789 4/1992 Aramaki ..... 123/520
5,143,035 9/1992 Kayanuma ..... 123/198 D

*Primary Examiner*—Carl S. Miller
*Attorney, Agent, or Firm*—George L. Boller; Russel C. Wells

[57] ABSTRACT

An on-board diagnostic system determines if there is a leak in the portion of a canister purge system that includes the fuel tank and the canister that collects volatile fuel vapors from the fuel tank's headspace. A vacuum regulator/sensor placed in the conduit between the CPS valve and the canister, includes a switch providing a signal indicating the presence or absence of a leak. The sensor also indicates both positive and negative pressures relative to a reference pressure such as atmosphere. During diagnostic testing, the switch is closed and if the switch becomes open this indicates a leak in the headspace of fuel tank on the canister.

15 Claims, 2 Drawing Sheets

TO ENGINE COMPUTER
ENGINE COMPUTER
ATMOSPHERE
NORMALLY OPEN SOLENOID
CARBON CANISTER
FUEL TANK
VACUUM REGULATOR/SENSOR
ENGINE COMPUTER
ENGINE COMPUTER
ENGINE PARAMETERS
CAN
VAC
ENGINE INTAKE MANIFOLD

DIAGNOSTIC SYSTEM FOR CANISTER PURGE SYSTEM

REFERENCE TO A RELATED APPLICATION

This application is a continuation-in-part of allowed application Ser. No. 07/676,672, filed Mar. 28, 1991.

FIELD OF THE INVENTION

This invention relates generally to evaporative emission control systems that are used in automotive vehicles to control the emission of volatile fuel vapors. Specifically the invention relates to an on-board diagnostic system for determining if a leak is present in a portion of the system which includes the fuel tank and the canister that collects volatile fuel vapors from the tank's headspace.

BACKGROUND AND SUMMARY OF THE INVENTION

U.S. governmental regulations require that certain future automobiles that are powered by volatile fuel such as gasoline have their evaporative emission control systems equipped with on-board diagnostic capability for determining if a leak is present in a portion of the system which includes the fuel tank and the canister. One proposed response to that requirement is to connect a normally open solenoid valve in the canister vent, and to energize the solenoid when a diagnostic test is to be conducted. A certain vacuum is drawn in a portion of the system which includes the tank headspace and the canister, and with the canister and the tank headspace not being vented due to the closing of the canister vent, a certain loss of vacuum over a certain time will be deemed due to a leak. Loss of vacuum is detected by a transducer mounted on the fuel tank. Because of the nature of the construction of typical fuel tanks, a limit is imposed on the magnitude of vacuum that can be drawn. Too large a vacuum will result in deformation and render the measurement meaningless. In order to avoid this problem, a relatively costly vacuum transducer is required.

The present invention provides a solution to the problem which is significantly less costly. The key to the solution is a new and unique vacuum regulator/sensor which is disposed in the conduit between the canister purge solenoid and the canister. This vacuum regulator/sensor is like a vacuum regulator but with the inclusion of a switch that is used to provide a signal indicating the presence or the absence of a leak.

One aspect of the disclosed vacuum regulator/sensor that is especially unique is the manner in which the switch is embodied in it. Specifically, the movable valve element is a carbon-filled fluorosilicon that when seated on the associated valve seat, not only closes the valve seat, but also provides closure of the switch by bridging two electrical contacts that are embedded in the seat and that lead to corresponding terminals at the exterior of the vacuum regulator/sensor which provide the switch signal to external electronics.

Another aspect relates to the ability of the disclosed vacuum regulator/sensor to sense and indicate both positive and negative pressures relative to a reference (atmosphere), and this feature is useful in the performance of a multiple-part diagnostic test that takes into account the possibility that the ambient temperature might be sufficiently high enough to be volatilizing the liquid fuel at a rate that might otherwise impair the validity of the diagnostic test.

Further specific details of the construction and arrangements of the vacuum regulator/sensor and the system, and of the method of operation thereof, will be presented in the ensuing description.

Drawings accompany this disclosure and portray a presently preferred embodiment of the invention according to the best mode presently contemplated at this time for carrying out the invention.

DESCRIPTION OF THE PREFERRED EMBODIMENT

Figures 1, 3:
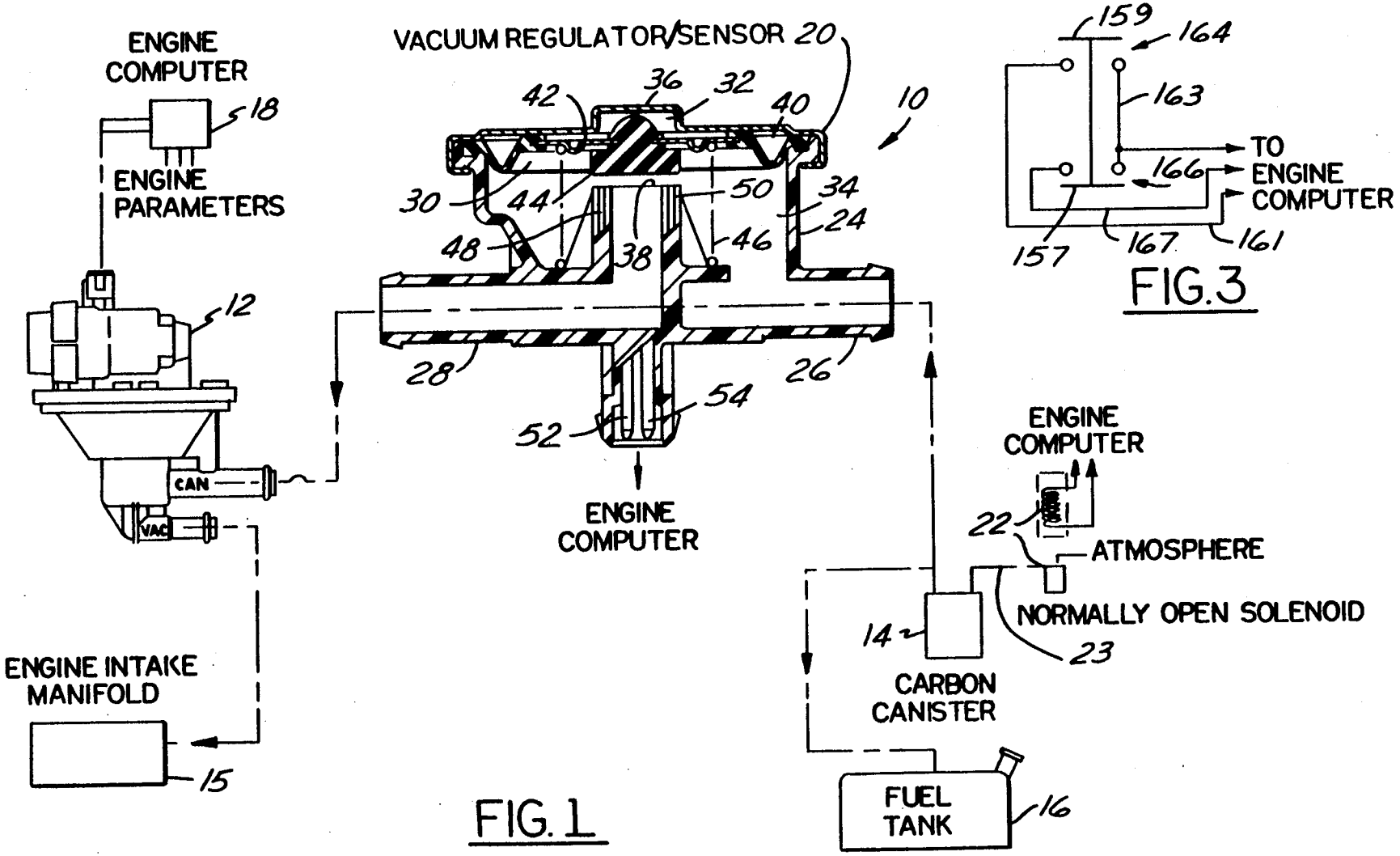
FIG. 1 is a schematic diagram, portions of which are in cross section, of a first embodiment of canister purge system, including the diagnostic system of the present invention.
FIG. 3 is an electrical schematic diagram related to the embodiment of FIG. 2.

FIG. 1 shows a representative canister purge system 10 embodying principles of the invention. System 10 comprises a canister purge solenoid valve 12 (CPS valve 12), and a carbon canister 14, associated with the intake manifold 15 of an automotive vehicle internal combustion engine and with a fuel tank 16 of the automotive vehicle which holds a supply of volatile liquid fuel for powering the engine. CPS valve 12 is under the control of an engine management computer 18 for the engine.

In accordance with the invention, a vacuum regulator/sensor 20 (VRS 20), and a normally open solenoid valve 22 are associated with system in the following manner. VRS 20 is disposed in the flow conduit between CPS valve 12 and canister 14, and solenoid valve 22 is disposed in the atmospheric vent conduit 23 that vents the canister to atmosphere.

VRS 20 comprises a housing 24 that has an inlet nipple 26 and an outlet nipple 28 via which it is connected into the flow conduit between CPS valve 12 and canister 14, as shown. Internally, VRS 20 comprises a diaphragm 30 that divides VRS 20 into a first chamber space 32 and a second chamber space 34. Chamber space 32 is vented to atmosphere via a vent 36 through a portion of the wall of housing 24. Outlet nipple 28 is at one end of a conduit that is formed in housing 24, and the other end of this conduit forms a valve seat 38 that coaxially faces diaphragm 30.

Diaphragm 30 comprises an outer diaphragm part 40 that enables the diaphragm to be positioned axially within housing 24, and an inner, and relatively rigid, inner part 42 that centrally carries a valve element 44 adapted for coaction with valve seat 38. A helical spring 46 is disposed within chamber space 34 and acts between a wall portion of housing 24 and inner diaphragm part 42 to urge the diaphragm, and hence the valve element, away from valve seat 38.

Embedded within housing 24 are two electrical contacts 48 and 50. They are arranged in valve seat 38 to be bridged by valve element 44 when the latter seats on valve seat 38 in a manner to be subsequently described. Internally of housing 24, each contact 48, 50 leads to a corresponding terminal 52, 54 which, in cooperation with a surrounding portion of the housing wall form an external electrical connector plug that can be mated with a mating connector plug (not shown) that leads to computer 18. By making the housing from a suitable plastic material which is not electrically conductive, the terminals and contacts can be formed electrical conductors that are insert-molded into the housing when the latter is fabricated.

Valve element 44 cooperates with contacts 48, 50 to form a normally open switch, which is illustrated in the normally open condition in FIG. 1. To accomplish this, valve element 44 is constructed to provide an electrically conductive path between the two contacts when the valve element is seated on seat 38. One way of providing this path is by making the valve element itself electrically conductive. A material which can provide a suitable character for performing the valving function as well as a suitable character for performing the electrical conductor function is carbon-filled fluorosilicon. While this particular construction for the switch is particularly novel, generic aspects of the invention contemplate that other specific switch constructions could be associated with a vacuum regulator/sensor.

The system functions in the following manner. With the canister vent open and the CPS valve being operated by the engine management computer, purging flow of vapors from the canister to the intake manifold is conducted under conditions conducive for purging. VRS 20 remains open and imposes no significant restriction in the purge flow. When it is desired to perform a test of the system to determine if a leak is present in that portion of the system which is upstream of VRS 20 and includes the canister and fuel tank, solenoid valve 22 is operated closed by computer 18.

At the same time, CPS valve 12 is operated by the computer to communicate the intake manifold through VRS 20 to the canister and tank headspace. With the engine operating to provide a suitable level of engine manifold vacuum, vacuum begins to be drawn in the canister and the tank headspace because they are no longer vented to atmosphere due to the closure of solenoid valve 22. Since this increasing vacuum is present in chamber space 34, there is an increasing pressure differential across diaphragm 30 which acts against spring 46. Accordingly, the diaphragm increasingly moves valve element 44 toward valve seat 38.

When a certain magnitude of vacuum is reached, valve element 44 seats on seat 38 to close the flow path through the VRS. At the same instant, the valve element bridges contacts 48 and 50 to provide a switch closure signal to the computer via terminals 52, 54. The closure of VRS 20 results in the vacuum being sealed in that portion of the system which is upstream of the VRS. The magnitude of the ensealed vacuum is equal to the vacuum that existed just as the VRS closed. However, since the intake manifold vacuum is of a larger magnitude, that larger magnitude will be applied to the seated valve element 44, in effect creating an extra sucking force at the center of the diaphragm to hold the diaphragm against the valve seat.

If a leak is present in the ensealed portion of the system, the ensealed vacuum will being to diminish. A predetermined loss of vacuum within a predetermined time is deemed to indicate the presence of a leak. Therefore, VRS 20 is designed such that during the testing time period, the existence of a leak is indicated by valve element 44 unseating from seat 38 such that the bridging contact of the valve element with the electric contacts 48 and 50 is lost whereby the switch signal from the VRS to the computer changes from closed to open. In other words, if the computer detects a change from closed to open of the VRS during the test period, the existence of a leak is indicated.

The invention is advantageous because the VRS can be mass-produced in a more economical fashion in comparison to the tank-mounted vacuum transducer solution described earlier. Moreover, the invention can enable a test to be performed at relatively small vacuum levels in the canister and fuel tank so that the drawing of vacuum therein will not cause deformation of properly designed canisters and tanks.

The increased sucking force exerted on the center of the diaphragm when VRS 20 closes provides a very useful hysteresis effect. For example if a vacuum of ten inches of water is effective to close the VRS, the trapped vacuum must drop a certain amount below ten inches of water before the VRS will re-open, say a drop of two inches of water from ten to eight inches. In order to adapt the invention to any particular system for a particular test procedure, calculations must be made in accordance with conventional engineering design practices so that the VRS design is properly sized for operation in the intended manner. It should also be mentioned that at the completion of a test the canister vent is reopened by de-energizing solenoid valve 22.

If a test is conducted above a certain temperature, it is possible that vapor may be generated at a rate that is sufficiently fast that the increase in vapor pressure will re-open the VRS, in which case the test result could indicate a leak when none actually exists. To avoid a faulty test, a temperature sensor may be mounted on the fuel tank to provide a fuel temperature measurement to the computer. If the temperature is not below a predetermined temperature above which the generation of vapor could affect the validity of the test, the test would be deemed invalid. Valid testing would therefore occur only below the predetermined temperature.

Figure 2:
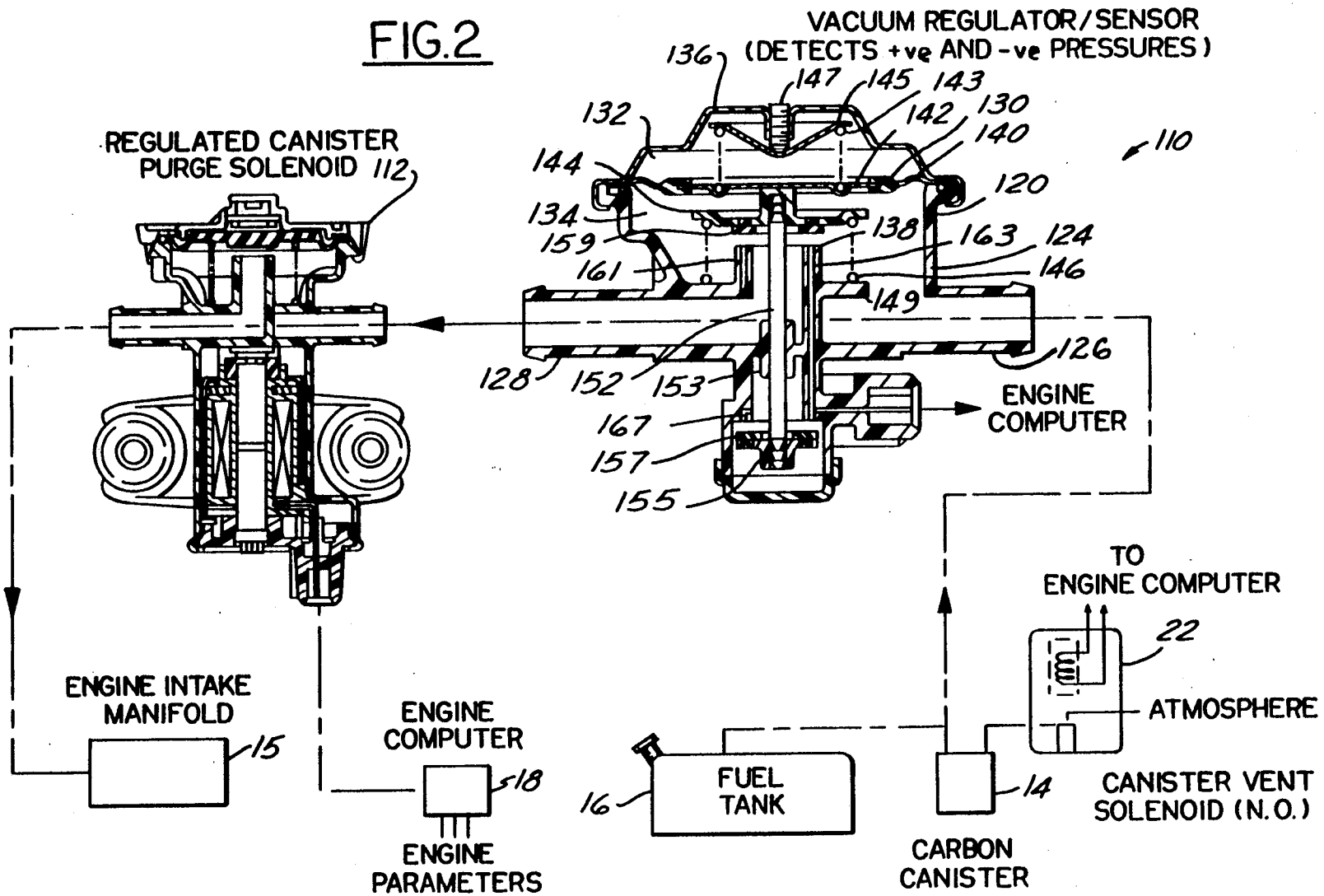
FIG. 2 is a schematic diagram, portions of which are in cross section, of a second embodiment of canister purge system, including the diagnostic system of the present invention.

FIGS. 2 and 3 disclose a second embodiment of canister purge system 110. The system contains a number of parts that are like corresponding parts in FIG. 1, and so like reference numerals are used to designate like parts in both embodiments. The primary constructional difference between the two embodiments resides in the VRS of each, the VRS of FIG. 2 being identified by the numeral 120. System 110 differs also in that its CPS valve 112 is specifically depicted as a regulated canister purge solenoid of the type manufactured and sold by the Assignee.

VRS 120 comprises a housing 124 that has an inlet nipple 126 and an outlet nipple 128 via which the VRS is connected in the flow path between canister 14 and engine intake manifold 15. As in the first embodiment, CPS valve 112 is connected in the flow path downstream of VRS 120. Internally, VRS 120 comprises a diaphragm 130 which divides housing 124 into a first, or reference, chamber space 132 and a second, or sensing, chamber space 134. The latter chamber space is included in the flow path through housing 124 between nipple 126 and nipple 128. Chamber space 132 is vented to atmosphere through a vent hole 136 in the housing wall. Nipple 128 is at one end of a conduit that is formed in housing 124, and the other end of this conduit forms a valve seat 138.

Diaphragm 130 comprises an outer part 140 that enables the diaphragm to be positioned axially within the housing, and a relatively rigid inner part 142. A helical coil spring 143 is disposed in chamber space 132 and acts to urge diaphragm 130 in a sense that is toward seat 138. One end of spring 143 is seated on inner part 142 while the other end of the spring seats on the outer margin of a spring seat element 145. Element 145 has a central conical depression that is concave toward a set screw 147 that is threaded into the wall of housing 124. The set screw is externally adjustable by means of a suitable adjustment tool (not shown) for setting the depth to which the set screw penetrates the housing. The interior tip end of the set screw bears against the bottom of the concave conical depression in element 145.

A somewhat disc-shaped valve element 144 is associated with seat 138. A second helical coil spring 146 is disposed between an internal housing wall 149 and the outer margin of element 144 and acts to urge element 144 in a sense that is away from seat 138. The central region of element 144 contains a projecting tip 151 that bears against the central region of inner part 142 of diaphragm 130. Valve element 144 is joined to a stem 152 Which passes from the element through the opening circumscribed by seat 138 and also through a guide sleeve 153 that is formed in housing 124. The end of stem 152 which is opposite valve element 144 is joined to a disc 155 which carries a switch contact 157. Valve element 144 also carries a switch contact 159. The condition assumed in FIG. 2 by the parts that constitute the inner workings of VRS 120 represents one of equal pressures acting on opposite sides of the diaphragm, e.g. both chamber spaces at atmospheric pressure.

Embedded within the housing are several electric conductors. Two conductors 161, 163 terminate as contacts at seat 138; two conductors 163, 167 terminate as contacts which confront disc 155. Switch contact 159 cooperates with the contact terminations of conductors 161, 163 to form a first, normally open switch 164 while switch contact 157 cooperates with the contact terminations of conductors 163, 167 to form a second, normally open switch 166. Conductor 163 is common to both switches. These switches are schematically portrayed in FIG. 3. Contacts 157, 159 are made from conductive elastomer, like the element 44 in FIG. 1.

With canister vent solenoid 22 open to atmosphere, canister purge system 110 performs canister purging in conventional fashion by the operation of CPS valve 112 from engine computer 18. During canister purging, VRS 120 remains open to allow the purge flow.

The inclusion of VRS 120 and vent solenoid 22 enable a two-part diagnostic test to be performed to test for possible leaks to atmosphere in the portion of the system that is upstream of VRS 120, i.e. in the canister and the tank headspace and associated conduits.

The first part of the diagnostic test comprises determining the rate at which fuel is being volatilized in the fuel tank. This part is commenced by closing (de-energizing) CPS valve 112 and by closing (energizing) vent solenoid 22. It can be assumed that the pressures across the diaphragm are essentially equal at the beginning of this part of the test. If vapor is being generated at a sufficiently high rate, the pressure in the sensing chamber will increase at a sufficiently rapid rate that diaphragm 130 will move upwardly against the force of spring 143. Although it is not fixedly attached to the diaphragm, valve element 144 will follow the diaphragm's motion because of spring 146. A sufficiently high rate of vapor generation will create a sufficient amount of travel within a certain measure of time that switch 166 will close and thereby provide a signal to the computer. Should the pressure continue to build after the switch has closed, the diaphragm will separate from the projecting tip of the valve element since the two are not fixedly connected.

The computer contains a timer that is started at the beginning of the test and that is stopped when switch 166 closes, assuming that such closure occurs before an allotted time. Of course if closure does not occur within the allotted time, then the rate at which vapor is being generated is deemed sufficiently slow that it will not affect the validity of the second part of the test. By measuring how long it takes for the switch to close, one can obtain the rate at which vapor is being generated. This information is used to validate or invalidate the results of the second part of the test which will now be described.

The second part is the actual leakage test. This is commenced by closing vent solenoid 22 and energizing CPS solenoid 112 until valve element 144 is forced by the downward motion of diaphragm 130 to seat switch contact 159 on seat 138 and thereby close the flow path through the VRS and concurrently close switch 164. Should the switch fail to close, it is assumed that a gross leak is present in the system since the intake manifold vacuum in that case is unable to draw sufficient vacuum in sensing chamber space 134 to cause the diaphragm to be moved downward and force valve element 144 to close against the valve seat. When closure of switch 164 is detected by the computer, CPS valve 112 is operated to reduce the magnitude of manifold vacuum delivered to nipple 128, and a timer in the computer is started. This timer measures the time required for valve element 144 and switch contact 159 to unseat from the seat and hence re-open switch 164 concurrent with the re-opening of the flow path through the VRS. Consequently, if a leak which is less than a gross leak, but nonetheless still an unacceptable one, is present, switch 164 will open within a predetermined time established by the timer. If no such leak is present, the timer will time out without the switch having opened.

However, failure of switch 164 to open within the period established for the timer does not inherently confirm that there is no unacceptable leakage because the presence of a leak may be masked if the liquid fuel is being volatilized at a sufficiently fast rate. Therefore, if the leak test indicates that no leakage is present, the test validity is either confirmed or denied by the result of first part of the test. If a leak test is deemed invalid, it must be repeated at another time when the vapor generation rate is sufficiently slow to confirm its validity.

Having disclosed generic principles of the invention, this application is intended to provide legal protection for all embodiments falling within the scope of the following claims.

What is claimed is:

1. A canister purge system comprising a collection canister for collecting volatile fuel vapors from a fuel tank, and means for selectively purging collected fuel vapors from said canister to an internal combustion engine's intake manifold for entrainment with a combustible mixture that passes from the manifold into combustion chamber space of the engine for combustion therein, said means including a purge flow path between said canister and manifold, characterized by a diagnostic system that detects unacceptable leakage in a portion of the canister purge system which portion includes said canister and tank and that comprises atmospheric vent means for selectively venting and unventing the canister and headspace of the tank to atmosphere and vacuum regulator/sensor means that is disposed in said flow path and that is selectively operable to open and close said flow path, characterized further by means for causing said diagnostic system to perform a multiple-part diagnostic test to determine whether any such leakage is present comprising means for performing one part of the test comprising pressure increase detection means comprising means for operating said atmospheric vent means to unvent said portion of the canister purge system to atmosphere, flow control means disposed in said flow path between said vacuum regulator/sensor means and intake manifold for selectively opening and closing said flow path, and means for obtaining a measurement of increase in the vapor pressure in said portion in consequence of unventing of said portion to atmosphere and of closing of said flow path by said flow control means, and means for performing another part of the test comprising means for performing a leakage test on said portion comprising means for operating said atmospheric vent means to unvent said portion to atmosphere and means for operating said flow control means to open said flow path so as to allow engine intake manifold vacuum to commence drawing vacuum in said portion, said vacuum regulator/sensor means comprises means for closing said flow path upon the drawing of a certain magnitude of vacuum in said portion within a certain measure of time indicative of the absence of a gross unacceptable leak in said portion, means for distinguishing a gross unacceptable leak in said portion from less gross unacceptable leaks by distinguishing the non-attainment of closure of said flow path by said vacuum regulator/sensor means within said measure of time from the attainment of closure of said flow path by said vacuum regulator/sensor means within said measure of time, means effective after the attainment of closure of said flow path by said vacuum regulator/sensor means within said measure of time for operating said flow control means to cause the magnitude of manifold vacuum delivered through said flow path to said vacuum regulator/sensor means to be attenuated from the magnitude that was delivered prior to closure of said flow path by said vacuum regulator/sensor means, and indicator means for indicating the absence of such a less gross unacceptable leak comprising means for indicating whether or not said vacuum regulator/sensor means has, after having closed said flow path, maintained said flow path closed for a certain period of time, and if maintenance of closure of said flow path for said certain period of time is not indicated, for distinguishing between the presence and absence of such a less gross unacceptable leak comprising means for utilizing the measurement obtained from said one test in distinguishing between the presence and absence of such a less gross unacceptable leak.

2. A system as set forth in claim 1 in which said means for obtaining a measurement of increase in the vapor pressure in consequence of unventing of said portion to atmosphere and of closing of said flow path by said flow control means comprises measuring means for measuring the time required for the vapor pressure in said portion to undergo a predetermined increase relative to a reference pressure.

3. A system as set forth in claim 2 in which said vacuum regulator/sensor means comprises a reference chamber space that is referenced to atmospheric pressure and a sensing chamber space that is included by said portion, and said measuring means comprises means for measuring the time required for the vapor pressure in said sensing chamber space to undergo a predetermined increase in relation to atmospheric pressure in said reference chamber space and comprises a switch that is disposed on said vacuum regulator/sensor means to assume a non-actuated condition at the commencement of measuring and is operated to actuated condition when said predetermined increase in vapor pressure in said sensing chamber space is attained.

4. A system as set forth in claim 3 in which said switch is open circuit when in non-actuated condition and closed circuit when in actuated condition.

5. A system as set forth in claim 1 in which said indicator means comprises switch means which is disposed on said vacuum regulator/sensor means and is operated from non-actuated condition to actuated condition upon said vacuum regulator/sensor means operating to close said flow path, and the length of time that said switch means is in its actuated condition distinguishes between the presence and absence of such a less gross unacceptable leak.

6. A system as set forth in claim 5 in which said switch means is open circuit when in non-actuated condition and closed circuit when in actuated condition.

7. A system as set forth in claim 1 in which said means for obtaining a measurement of increase in the vapor pressure in consequence of unventing of said portion to atmosphere and of closing of said flow path by said flow control means comprises measuring means for measuring the time required for the vapor pressure in said portion to undergo a predetermined increase relative to a reference pressure, and said indicator means comprises switch means which is disposed on said vacuum regulator/sensor means and is operated from non-actuated condition to actuated condition upon said vacuum regulator/sensor means operating to close said flow path, and the length of time that said switch means is in its actuated condition distinguishes between the presence and absence of such a less gross unacceptable leak.

8. A system as set forth in claim 1 in which said vacuum regulator/sensor means comprises a reference chamber space that is referenced to atmospheric pressure and a sensing chamber space that is included by said portion, said chamber spaces being divided by a movable wall, a first spring means that is disposed in said reference chamber space and is effective to urge said movable wall in a sense that is toward causing said vacuum regulator/sensor means to close said flow passage, and a second spring means that is disposed in said sensing chamber and is effective to urge said movable wall in a sense that is away from causing said vacuum regulator/sensor means to close said flow passage.

9. In a canister purge system comprising a collection canister for collecting volatile fuel vapors from a fuel tank, and means for selectively purging collected fuel vapors from said canister to an internal combustion engine's intake manifold for entrainment with a combustible mixture that passes from the manifold into combustion chamber space of the engine for combustion therein, said means including a purge flow path between said canister and manifold, a method for diagnosis of unacceptable leakage in a portion of the canister purge system which portion includes said canister and tank, said method comprising performing a multiple-part diagnostic test to determine whether any such leakage is present comprising performing one part of the test by measuring increase in the vapor pressure in said portion in consequence of unventing said portion to atmosphere and of closing said flow path between said canister and intake manifold, and performing another part of the test comprising performing a leakage test on said portion by unventing said portion to atmosphere and opening said flow path so as to allow engine intake manifold vacuum to commence drawing vacuum in said portion, thereafter closing said flow path between said canister and intake manifold upon the drawing of a certain magnitude of vacuum in said portion within a certain measure of time indicative of the absence of a gross unacceptable leak in said portion, distinguishing a gross unacceptable leak in said portion from less gross unacceptable leaks by distinguishing the non-attainment of closure of said flow path within said measure of time from the attainment of closure of said flow path within said measure of time, and after the attainment of closure of said flow path within said measure of time, indicating the absence of such a less gross unacceptable leak by maintaining said flow path closed for a certain period of time, and if maintenance of closure of said flow path for said certain period of time is not indicated, for distinguishing between the presence and absence of such a less gross unacceptable leak by utilizing the measurement obtained from said one test in distinguishing between the presence and absence of such a less gross unacceptable leak.

10. A canister purge system for purging of fuel vapors from a canister to an internal combustion engine's intake manifold for entrainment with a combustible mixture to be introduced into and combusted in combustion chamber space of the internal combustion engine comprising a diagnostic system for detecting a leak in a portion of the canister purge system which includes the canister and a tank from which the canister collects fuel vapors characterized in that in an atmospheric vent for the canister and the tank headspace there is a normally open solenoid valve that is energized to close the vent during a diagnostic leak test, and in the flow path from the canister to the intake manifold there is a vacuum regulator/sensor that is effective to close the flow path after a certain vacuum has been drawn in the canister and tank headspace by vacuum from the intake manifold so that said certain vacuum is trapped therein and that comprises a switch which closes upon the closing of said flow path by said vacuum regulator/sensor and opens upon the re-opening of said flow path by said vacuum regulator/sensor in the event of a predetermined loss of trapped vacuum within a predetermined time after the closing of said vacuum regulator/sensor.

11. A system as set forth in claim 10 in which said switch comprises a pair of contacts embedded in a valve seat of said vacuum regulator/sensor and a conductive path that is carried by a valve element that coacts with said valve seat and that bridges said contacts when said valve element is seated on said valve seat.

12. A system as set forth in claim 11 in which said valve element comprises a carbon-filled fluorosilicone.

13. A canister purge system for purging of fuel vapors from a canister to an internal combustion engine's intake manifold for entrainment with a combustible mixture to be introduced into and combusted in combustion chamber space of the internal combustion engine comprising a diagnostic system for detecting a leak in a portion of the canister purge system which includes the canister and a tank from which the canister collects fuel vapors characterized by means for drawing a vacuum in the canister and tank headspace and for detecting loss of vacuum, said means comprising a vacuum regulator/-sensor means in the flow path from the canister to the intake manifold, said vacuum regulator/sensor means being effective to close the flow path after a certain vacuum has been drawn in the canister and tank headspace by vacuum from the intake manifold so that said certain vacuum is trapped therein, and to detect the closing of said flow path by said vacuum regulator/sensor means.

14. A system as set forth in claim 13 in which said vacuum regulator/sensor means also detects the re-opening of said flow path by said vacuum regulator/-sensor means in the event of a predetermined loss of trapped vacuum with a predetermined time after the closing of said flow path by said vacuum regulator/sensor means.

15. A system as set forth in claim 14 in which said vacuum regulator/sensor means comprises a normally open switch which closes upon closing of said flow path by said vacuum regulator/sensor means and re-opens upon re-opening of said flow path by said vacuum regulator/sensor means.

* * * * *